US007178773B2

(12) United States Patent
Wedi

(10) Patent No.: US 7,178,773 B2
(45) Date of Patent: Feb. 20, 2007

(54) SURFACE MOUNT LAMP

(75) Inventor: Heinz-Friedbert Wedi, Breckerfeld (DE)

(73) Assignee: ERCO Leuchten GmbH, Ludenscheid (DE)

( * ) Notice: Subject to any disclaimer, the term of this patent is extended or adjusted under 35 U.S.C. 154(b) by 86 days.

(21) Appl. No.: 11/046,665

(22) Filed: Jan. 28, 2005

(65) Prior Publication Data

US 2006/0175516 A1 Aug. 10, 2006

(51) Int. Cl.
*E04G 3/00* (2006.01)

(52) U.S. Cl. ..... 248/278.1; 362/285

(58) Field of Classification Search ..... 248/274.1, 248/276.1, 278.1, 279.1, 280.11; 362/648, 362/285, 269

See application file for complete search history.

(56) References Cited

U.S. PATENT DOCUMENTS 4,470,106 A * 9/1984 Norton ..... 362/398
5,325,281 A 6/1994 Harwood
5,845,885 A 12/1998 Carnevali
2003/0223234 A1* 12/2003 Tang ..... 362/226
2004/0251389 A1* 12/2004 Oddsen, Jr. ..... 248/279.1
2005/0230585 A1* 10/2005 Hung ..... 248/278.1

FOREIGN PATENT DOCUMENTS

DE 9305456 4/1993
EP 0 567 739 3/1993
EP WO-1994/01717 1/1994

* cited by examiner

*Primary Examiner*—Ramon O Ramirez
(74) *Attorney, Agent, or Firm*—Andrew Wilford

(57) ABSTRACT

A device for mounting a lamp on a stationary support has a housing and first and second pivots on the housing for securing the housing to the support for pivoting of the housing on the support about first and second nonparallel axes. A first brake on the housing can free the housing to rotate on the support about the first axis or hold it to prevent the housing from rotating on the support about the first axis. Similarly, a second brake on the housing can free the lamp to rotate on the housing about the second axis or hold it to prevent it from rotating on the housing about the second axis. A single actuating element on the housing is connected to both of the brakes for jointly displacing them between the freeing and holding positions.

20 Claims, 6 Drawing Sheets

SURFACE MOUNT LAMP

FIELD OF THE INVENTION

The invention relates to a device for mounting a lamp on a stationary support surface, in particular on a power-track adapter, the lamp being pivotal about first and second axes relative to the stationary surface and at least a first and a second brake being provided for inhibiting pivotal movement.

BACKGROUND OF THE INVENTION

Such a device is disclosed by applicant in EP 0,567,739 which is used to secure the lamp on a stationary support surface, for example on a power-track adapter, so that it can be turned and secured in any angular position. The power-track adapter is mounted on a power track that is secured to a building surface, e.g. a ceiling.

This known device has as shown in FIG. 2 of EP 0,567,739 a generally L-shaped body with two rotary mounts A and B by means of which the lamp can be pivoted about a vertical axis y and a horizontal axis x. Each of the rotary mounts A and B is provided with a respective brake so as to lock in the set angular position.

To this end the first rotary mount A is formed by a hub on the body with a central part pivotal on the power-rail adapter. The hub is splined with a coaxial circular wheel. An underside of the wheel has teeth that coact with a gear carried on a bolt. The bolt extends through a hole on the body to a housing. The gear rotates freely when the holder is rotated on the power-tract adapter. It can however be fixed by a nut against the housing. In this manner pivoting of the rotary mount A can be inhibited.

The second rotary mount B works like the rotary mount A, the teeth being formed in a segment of the body and the gear being on an arm on the lamp.

The above-described device has shown itself to be relatively successful.

OBJECT OF THE INVENTION

Starting from this state of the art, it is an object of the invention to improve on the known device so that it is easier to use.

SUMMARY OF THE INVENTION

The invention achieves this object in that the device has an actuating element by means of which both brakes can be jointly actuated.

The basic idea of the invention is that once the lamp that has been positioned with respect to two axes it is locked in place by actuating one element. The positioning operation of the device according to the invention is thus particularly efficient because only one actuating element need be acted on. This is particularly important when a number of lamps must be positioned, as for example in a museum. Here for each exposition the lamps must be reset.

The loosening and tightening of the actuating element for adjusting the lamps was to date a laborious process. With the device according to the invention this job is much faster and easier. Roughly half of the time can be saved.

The device according to the invention serves for mounting a lamp on a stationary support surface, for example on a wall or a ceiling of a building. The lamp can either be mounted directly on the support surface or, for example, via a power rail adapter on a power-rail fixed to a wall or another similar support.

The actuating element can be constituted by very simple mechanical elements, for example screws or levers. In particular off-the-shelf parts can be used. The adjustment member can be any part that can transmit force and/or form a releasable connection and in this manner lock the lamp in any set angular position.

According to a feature of the invention the actuating element for actuating the brakes has at least one movable member. Such a movable member can serve to bridge the space between the actuating element and the adjustment member. This has the advantage that the position of the adjustment member can be freely chosen. It can be far from the actuating element.

It is advantageous here when the movable member serves both brakes. In this manner the structure is particularly advantageous and simple to assembly and stock since instead of two different adjustment members the apparatus only has one.

It is further possible that at least one of the brakes is carried on the movable member, which cuts costs for manufacture, assembly, and stocking. The movable member is integral with the adjustment member, preferably unitary.

Further preferably both brakes are carried on the movable member. This makes the structure very simple.

At least one of the brakes is unitary and/or in force-transmitting engagement with a complementary brake part. If the lamp is pivoted on the rotary mounts, e.g. on pivots, the movable element can be on one pivot part and the adjustment member on the other. Interaction of the adjustment member with the movable member locks the pivot.

If the braking is done by surface contact, only a very small shifting of the brake parts is needed. The surface contact between a brake face of one of the brake parts and a brake face of the other brake part can serve to lock the angular position of the lamp. In addition the surface contact can, when not too tight, provide some friction for setting and adjusting the position of the lamp so that the lamp can be set in a position and will hold there by the friction. The user who has for example with one hand set the desired lamp position, does not need to hold it in place while locking it, but can work comfortably with one hand.

An alternative connection between the brake elements can provide good braking, but in many circumstances requires a long adjustment stroke.

According to a preferred embodiment of the invention the brake part is fixed on the stationary support surface and/or on the lamp. It is furthermore advantages when a first brake part is fixed on the stationary support surface and a second brake part is fixed on the lamp. In this manner securing the first brake element on the stationary support surface. e.g. directly on a power-rail adapter or its mounting pin or the like, and the second brake part is mounted directly on the lamp. This simplifies manufacture and assembly of the apparatus that are connected together by the brake parts on the support and lamp.

The brake parts have respective brake faces that are pressable against each other. This feature of the invention makes it possible for the device to be very simple and to brake the pivoting with a small number of parts.

According to a preferred embodiment of the invention one brake face is generally concave. This has the advantage that the other brake face can be made convex. With this feature of the invention a jaw-type brake is formed that can exert particularly high forces so that even heavy lamps, e.g. heavy lamps, can be permanently locked in the selected angular position. The curved faces form a pair of surfaces that fit perfectly with each other over a large surface area. Thus they can hold very well.

According to a further preferred feature of the invention one brake engages with one brake face another brake face of a lamp-mounted brake part and the one brake face engages over the other brake face. With this embodiment of the invention the inner of the two pressed-together brake faces a preferably convex brake face that is surrounded by a complementarily concave brake face. With this arrangement particularly good braking is possible.

According to a further preferred embodiment of the invention, a movable-member projection engages around the lamp-mounted brake face. The projection is preferably at a foot of the adjustment member that, as described below, is formed by a housing shell. To secure the two housing shells together an end of the projection can be fitted between the outer housing shell and the lamp-mounted brake face so that the adjustment member can then be pivoted into place. If now a below-described wedge face is moved, the adjustment member is fixed on the other housing part. Thus an easily handled assembly is produced that is formed by the adjustment member and the other housing shell, and that subsequently is equipped with the lamp.

Preferably the two brake faces engage each other over more than 10°. The optimal angle depends on the curvature of the braking faces. Manufacturing tolerances also play a role, but because of the curved shape of the brake faces they are easy to control. It is mainly critical that more than a point or line contact is needed between the braking faces, instead a relatively large surface contact is desired.

According to a further preferred embodiment of the invention the lamp-mounted brake part has a bearing eye for the second pivot axis. This makes the structure simple because the lamp-mounted brake part here the second brake part, is mounted at the bearing eye on the second housing shell. The adjustment member, e.g. the first housing part, can be tightened in the space between the wedge face and the second housing shell relative to the second housing such that the two housing shells once tightened are secured to each other and the preassembled unit is secured by mounting tabs that are also preferably on the lamp-mounted brake part, are connected with the lamp.

According to a further preferred embodiment of the invention the device has a cover for concealing the lamp-mounted brake part. This creates a nice appearance and protects the parts from dirt.

According to a further preferred embodiment of the invention a head of the movable member carries a fixed brake part that cooperates with fixed brake part carried on the stationary support surface. The brake part fixed on the stationary surface is referred to in the following as the stationary brake part and is distinguished from the brake part mounted on the lamp.

According to a further preferred embodiment of the invention the stationary brake part is a ring set between two jaws. A first jaw can be formed by the first brake part on the adjustment member and the second jaw can be formed by the second housing shell. In general the stationary brake part is grippable between two jaws and can in this manner be solidly arrested, since considerable braking force can be exerted by two jaws.

According to a further embodiment of the invention the actuating element interacts with a slide arrangement. The slide arrangement allow movement of the actuating element to be transmitted to the adjustment member.

To operate at least one brake part the slide arrangement has at least one wedge face. The wedge face makes it simple and easy to actuate the adjustment member that engages the wedge face.

The wedge face interacts with another wedge face of an adjustment member. The interaction of the wedge faces is advantageous in that the movement transmitted through the slide arrangement is transmitted in the desired way to the brake faces.

According to a further preferred embodiment of the invention the actuating element directly engages and moves a part provided with the wedge face. This facilitates a particularly simple construction and application of considerable actuating force on the brake faces. Thus the wedge faces transmit considerable forces to the brake faces. In this manner it is possible for the adjustment member to exert considerable forces to arrest the adjustment member.

A further embodiment of the invention is that the actuating element acts on a first part of the slide arrangement that engages via a spring a second part with the wedge face. The spring allows one to apply a variable holding force that is also accurately adjustable.

According to a further embodiment of the invention the two faces are formed as wedge faces that convert an axial movement of the part having one of the wedge faces into a movement of the adjustment member in two different directions. This is a simple way to jointly actuate both brakes.

The wedge faces can shift between a rest position in which the lamp is pivotal about the axes and a holding position in which the lamp is fixed with respect to the axes. Between these end positions of the wedge faces, there are further wedge-face positions in which the lamp can be shifted about its axes through greater or less resistance.

According to a further embodiment of the invention there are two housing shells that when mounted on each other can move relative to each other. The adjustment member can be formed by one of the housing shells, so that a separate part need not be provided.

Thus according to the invention the adjustment member is formed by one of the housing shells, simplifying construction and reducing the number of parts.

According to a further preferred advantageous embodiment of the invention the wedge face serves to hold together the housing shells. The two housing shells are not mounted by screws, rivets, or similar fasteners, once again easing assembly.

A further feature of the invention is that the actuating element is a threaded screw. This makes it easy to use standard tools with the actuating element.

The threaded screw engages an internal screwthread in the element having the brake face or in the first part of the slide is arrangement. With this simple structure it is possible to easily displace the slide in a straight line.

BRIEF DESCRIPTION OF THE DRAWING

Further advantages are given in the uncited dependent claims as well as in the following description of an embodiment shown in the drawings. Therein:

SPECIFIC DESCRIPTION

Figure 1:
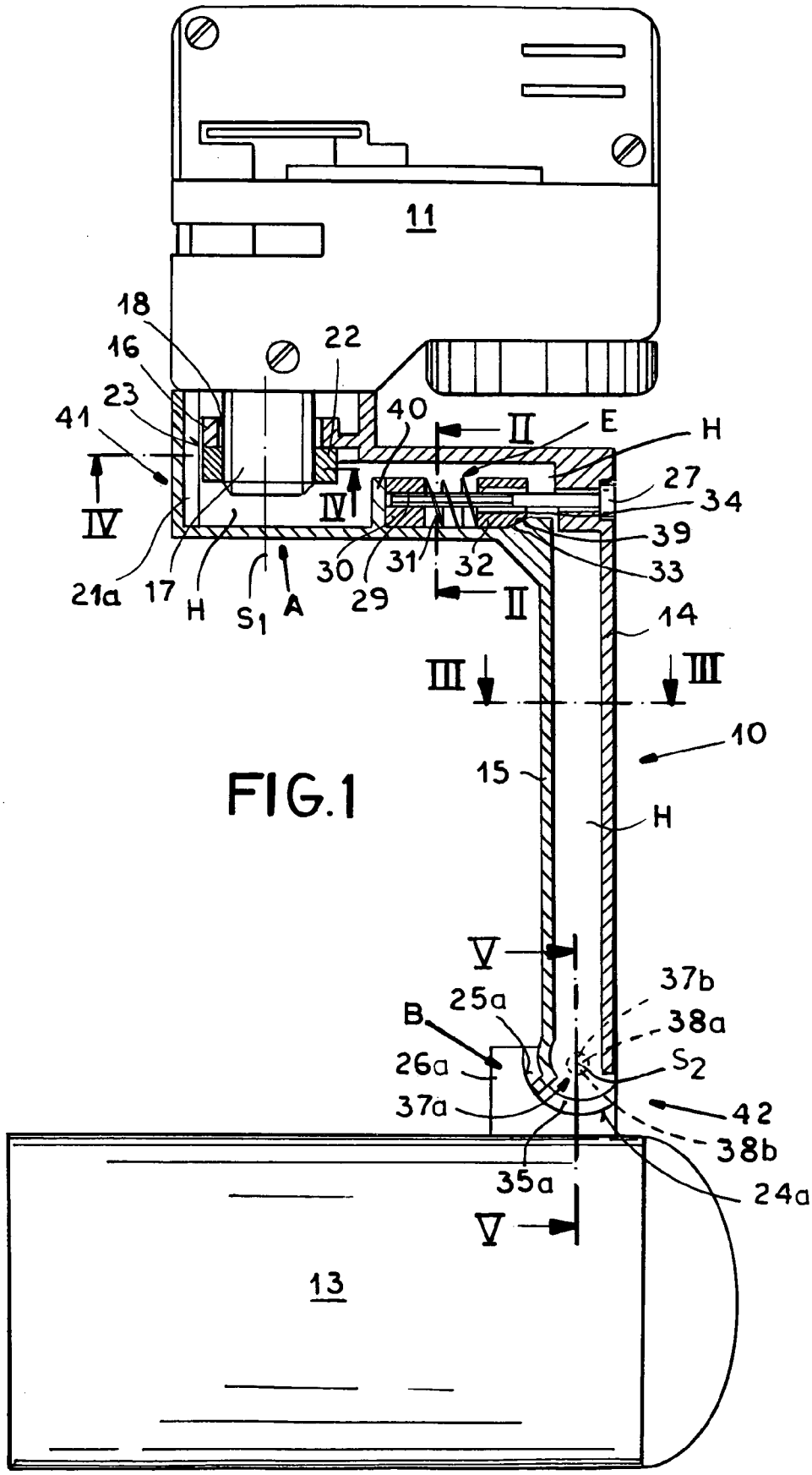
FIG. 1 is a schematic partly sectional view of an embodiment of the device according to the invention with a power-track adapter and lamp.

A device for mounting a lamp 13 is generally shown in the drawing at reference 10. In the following description of the drawing the same references are applied to the same or similar or similarly functioning parts or elements for the sake of simplicity. This allows a better overall view of the various embodiments.

The device 10 serves according to FIG. 1 for mounting a lamp 13 serving for example as emitter on a power-track adapter 11. It has a first rotary mount A in a head 41 of the device 10 and a second rotary mount B in a foot 42 of the device 10, so that the lamp 13 can be pivotally adjusted about perpendicular main axes $S_1$ and $S_2$. It is to be noted that the first pivot axis $S_1$ is stationary and the second pivot axis $S_2$ moves with the lamp 13 about the first pivot axis $S_1$. The power-track adapter 11 secures the device 10 in an unillustrated power track to supply the lamp 13 with line power.

Figure 3:
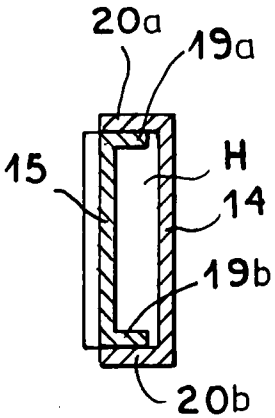
FIG. 3 is a section through the device along line III—III of FIG. 1.
Figure 2:
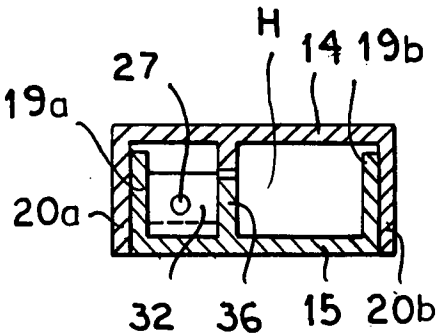
FIG. 2 is a section through the device along line II—II of FIG. 1.

The device 10 has a first housing shell 14 and a second housing shell 15 that are generally L-shaped and that together form a support arm. According to FIGS. 2 and 3 the housing shells 14 and 15 each are of U-section and have their open sides turned toward each other, with the inner housing shell 15 engaging into the outer housing shell 14. The housing shells 14 and 15 in this manner form a cavity H extending from the head 41 to the foot 42 of the device 10 through which unillustrated voltage-feed lines (e.g. 220 V) pass to supply the lamp 13.

Figure 4:
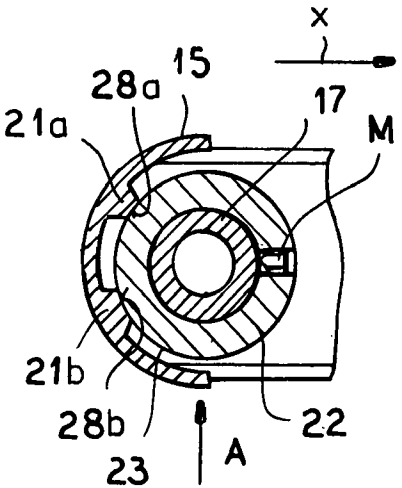
FIG. 4 is a section through the device along line IV—IV of FIG. 1.

The housing shell 14 is formed in the head 41 with an annular web 16 forming part of the first rotary mount A and having an opening 18 through which fits a hollow threaded bolt 17 that is fixed in the power-track adapter 11. In this manner the housing shell 14 is pivotal about the stationary axis $S_1$ on the threaded bolt 17. The threaded bolt 17 is held on the annular web 16 by a lock ring 22 that is threaded onto the threaded bolt 17 and fixed against rotation by a lock element M (see FIG. 4).

The housing shell 15 has near the annular web 16 ribs 21*a* and 21*b* that engage an outer brake face 23 of the ring 22 and that can frictionally inhibit rotation about the axis $S_1$ as described below in detail.

Figure 5:
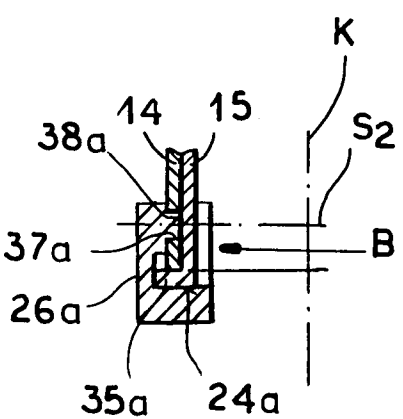
FIG. 5 is a section through the device along line V—V of FIG. 1.

The section of FIG. 5 shows for clarity's sake only a half of the rotary mount B which is mirror-symmetrical to a plane K. The outer housing shell 14 is formed in the foot 42 near the lamp 13 with diametrally opposite bores 37*a* and 37*b*. Flanges 26*a* of the lamp 13 are formed with pins 38*a* and 38*b* that engage in the bores 37*a* and 37*b* and support the lamp 13 for pivoting about the axis $S_2$ on the outer housing shell 14. The axis $S_2$ corresponds generally to a central longitudinal axis of the pins 38*a* and 38*b*. FIG. 5 only shows the back pin 38*a* of the pins 38*a* and 38*b* in the view direction of FIG. 3 and the bore 37*a* of the bores 37*a* and 37*b*.

The inner housing shell 15 has on its end turned toward the lamp 13 brake parts 35*a* that are formed as cylinder segments and that are provided with convex cylindrical outer brake faces 24*a*. These coact with concave cylindrical brake faces 25*a* of the flanges 26*a* to limit rotation.

Figure 7:
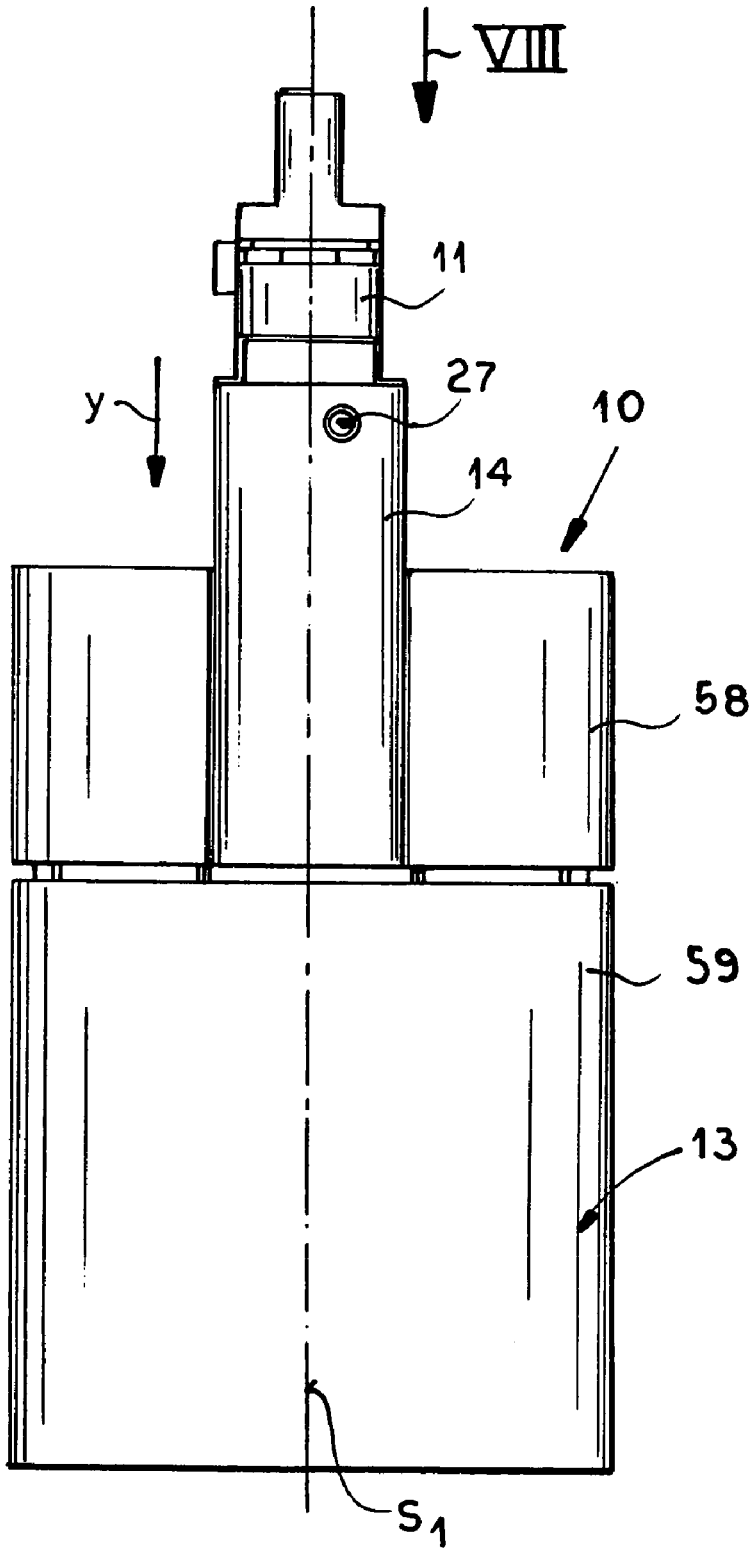
FIG. 7 is the embodiment of FIG. 6 seen in the direction of arrow VII of FIG. 6.
Figure 9:
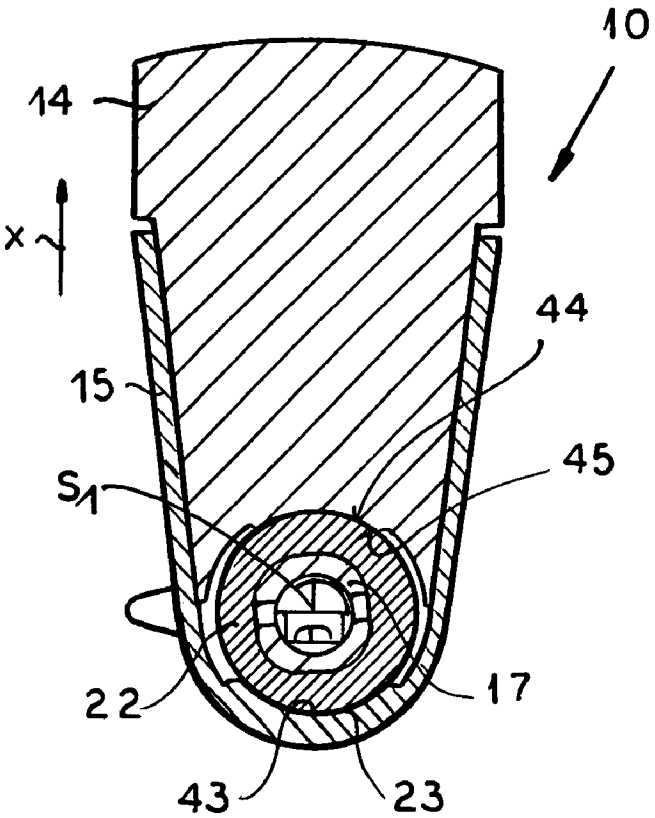
FIG. 9 is a section taken through the device according to line IX—IX of FIG. 6.

In the head 41 near the power-track adapter 11 of the device 11 there is a slide arrangement E in the cavity H between the housing shells 14 and 15. A threaded screw 27 is fitted to an internal screwthread 29 of a slide 30 so that the screw 27 can shift it in the direction of arrow x (FIG. 9). The threaded screw 27 bears with its head in a blind bore in the shell 14. The movement of the slide 30 is effective directly via a spring 31 on a shiftable wedge element 32 mounted on the screw 27 and having a wedge face 33 engaging a wedge face 34 of a projection 39 of the housing shell 15. The contact wedge faces 33 and 34 extend for example at an angle of 30° to the movement direction x of the wedge 32. The spring force effective in the direction x is thus transformed into forces in the directions x and y (FIG. 7). The slide 30 and the wedge 32 are guided by a ridge 36 shown in FIG. 2 and a side wall 19*a* of the housing shell 15.

The compression spring 31 between the slide 30 and the wedge 32 ensures that as the slide 30 is shifted in the direction x by actuation of the screw 27 the spring force is applied by the spring 31 to the wedge 32 increases. The wedge face 33 presses the housing shell 15 with increasing force toward the housing shell 14. The braking friction can therefore be adjusted and set accurately.

When the spring 31 is completely decompressed the slide 30 is in a position in which it bears on an abutment 40 of the housing shell 15. Only a very slight force will be applied to the wedge 30 and through it to the housing shell 14. The housing shells 14 and 15, which together form a support arm for the lamp 13, are pivotal against slight resistance together relative to the power-track adapter 11 about the pivot axis $S_1$. As a result of pivoting the support arm formed by the shells 14 and 15 relative to the stationary bolt 17, the ribs 21*a* and 21*b* (FIG. 4) move along the outer brake face 23 of the ring 22. Since the spring 31 is only slightly compressed, only a slight force will be exerted in the direction x on the housing shell 15 so that the ribs 21*a* and 21*b* will only bear lightly on the outer brake face 23 of the ring 22. Pivoting of the support arm about the pivot axis $S_1$ thus takes place against only minor friction during pivoting of the lamp 13 about the pivot axis $S_1$.

The lamp 13 is also pivotal against light resistance relative to the support arm about the axis $S_2$. During pivoting of the lamp 13 about the pivot axis $S_2$ relative to the support arm, a brake face 25*a* of a flange 26*a* slides along the complementary cylindrical outer brake face 24*a* of the housing shell 14. It must similarly be noted that only a modest force is exerted in the direction y by the spring 31 and the wedge 32 on the housing shell 15. Since the lamp 13 is connected by pins 38*a* and 38*b* fixedly with the outer shell 14 and since moving the housing shell 15 in the direction y shifts the brake faces 25*a* and 24*a* relative to each other, with only a modestly compressed spring 31 the brake faces 24*a* and 25*a* bear only lightly on each other. The force with which they bear on each other can be set higher or adjusted so that the desired pivotal position of the lamp 13 about the axis $S_2$ can be maintained by friction.

Actuation of the screw 27 after setting the position of the lamp 13 relative to the axes $S_1$ and $S_2$ moves the slide 30 in the direction x and thus increases the force exerted by the spring 31. The wedge 32 is pressed by the spring 31 in the direction x. The is force in the direction x is applied to the wedge face 34 and vectored into the directions x and y so that the housing shell 15 moves slightly relative to the housing shell 14 both in the direction x and in the direction y. Since side walls 20*a* and 20*b* of the housing shell 14 engage around the side walls 19*a* and 19*b* of the housing shell 15 (see FIGS. 2 and 3) the housing shells are guided during this movement. The housing shell 14 thus forms a lateral guide for the housing shell 15.

The force applied in the direction x ensures that end brake faces 28*a* and 28*b* (FIG. 4) of the ribs 21*a* and 21*b* are pressed against the outer brake face 23 of the ring 22 and thus frictionally inhibit rotation. Shifting of the housing 15 in the direction y presses the cylindrical brake faces 24*a* and 24*b* of the housing shell 15 against the brake faces 25*a* and 25*b* of the flanges 26*a* and 26*b* so that pivoting of the lamp 13 about the axis $S_2$ is frictionally inhibited.

Screwing-in the screw 27 simultaneously therefore applies the rotary mounts A and B. Releasing of the braking of the two axes $S_1$ and $S_2$ is simply effected by screwing out the screw 27 and thereby reducing the spring force. The housing shells thus can move into a position in which both rotary mounts A and B are released, that is are not holding.

The embodiment shown in the drawings provides for mounting the lamp 13 via the device 10 on a power-track adapter 11 that, as a result of being fixed to a stationary power track, forms the stationary support surface according to claim 1. Similarly embodiments of the device are conceivable by means of which the lamp 13 is mounted by the device 10 directly on a stationary support surface.

With this embodiment the cavity H of the device 10 can accommodate a number of voltage-supply lines. The device 10 according to the embodiment serves both for mechanically mounting the lamp 13 on the stationary support surface and for protecting the electrical feed lines for the lamp 13.

In an unillustrated embodiment of the invention it is possible for the device to serve only for the mechanical mounting of the lamp on a stationary support surface.

It is further worth noting that in the embodiment shown in the figures the pair of faces, that is the brake faces 28*a* and 23 of the rotary mount A and the pair of brake faces 25*a* and 24*a* of the rotary mount B are simple fiction or bearing surfaces. Alternatively near these brake faces in an unillustrated embodiment of the invention there can be teeth or the like that allow the faces to lock together.

Finally near the brake faces there can also be a friction-increasing element, for example a plastic part or layer. Such a friction-increasing element is not needed in every case.

In the following the second embodiment will be described with reference to FIGS. 6 to 10. Only the differences from the embodiment of FIGS. 1 to 5 are discussed, it being assumed that unless something is stated, the parts are functionally equivalent in the two embodiments.

Figure 6:
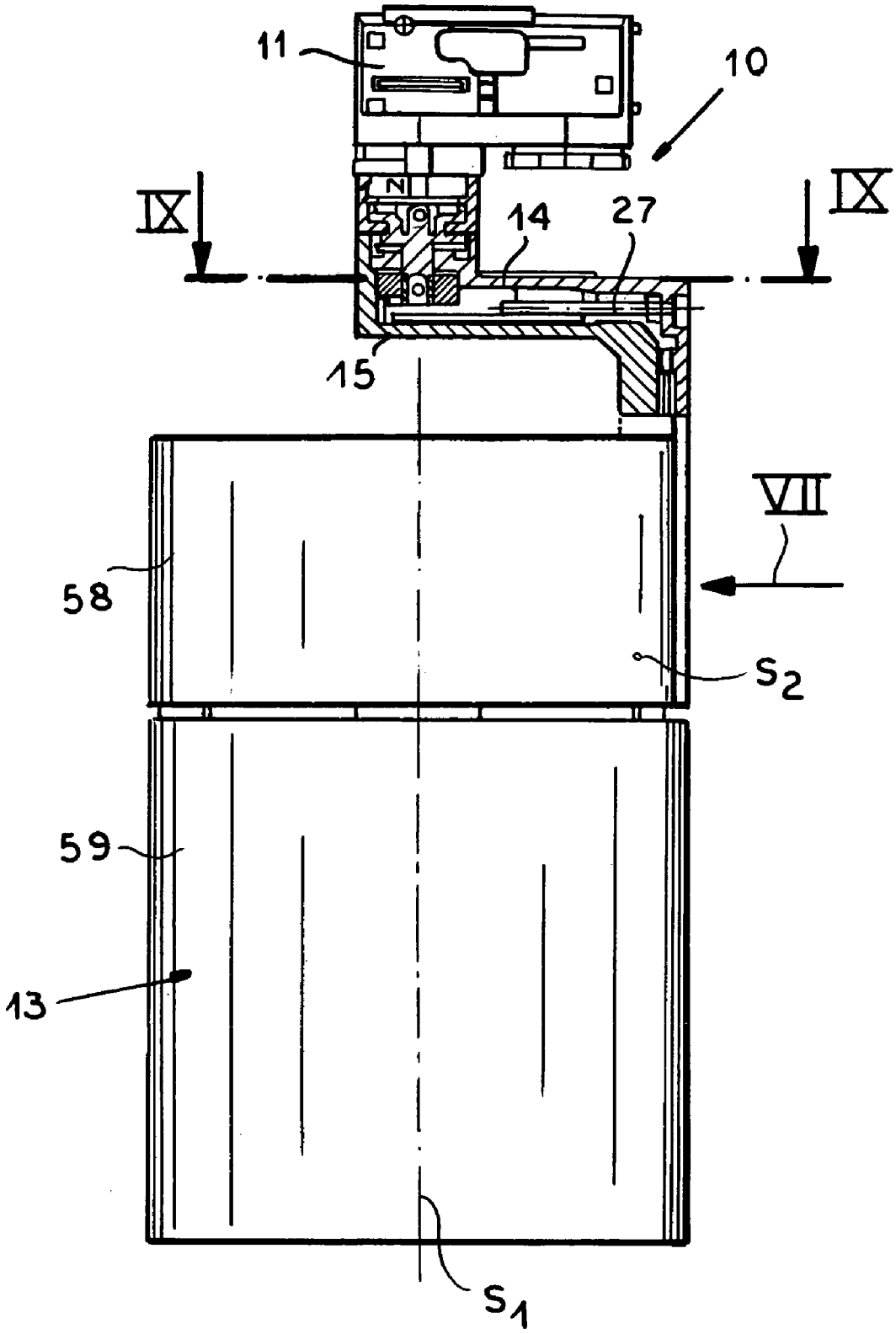
FIG. 6 is an overall view like FIG. 1 of a second embodiment of the device according to the invention showing the power-track adapter and the lamp.
Figure 8:
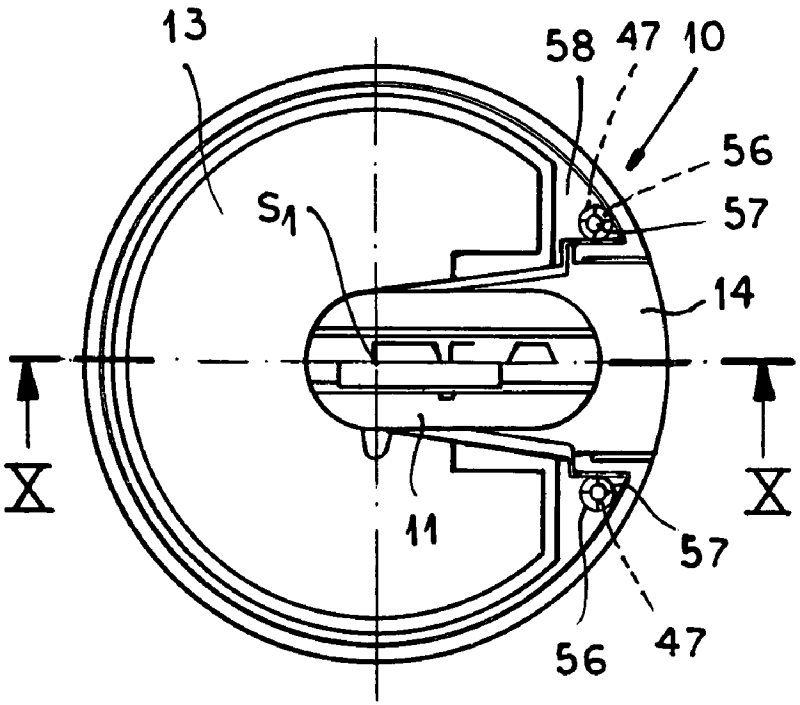
FIG. 8 is the device in top view according to arrow VIII of FIG. 7.

The second embodiment has a device 10 with a basically L-shaped body (FIG. 10) formed of two shells 14 and 15 and having a head 41 for connection to a power-track adapter 11 or another stationary support surface and a foot 42 connected on a lamp 13 or emitter. The views of FIGS. 6 to 8 show that with a generally vertical orientation of the lamp 13 according to FIG. 6 the vertical legs of the housing shells 14 and 15 are flush with the longitudinal sides of the lamp 13. Starting from the FIG. 6 position the lamp 13 can be rotated clockwise about the fixed pivot axis $S_2$, which also is called the fixed axis. The pivot angle of the lamp 13 relative to the device 10 can for example be 90° and be limited by unillustrated abutments.

Figure 10:
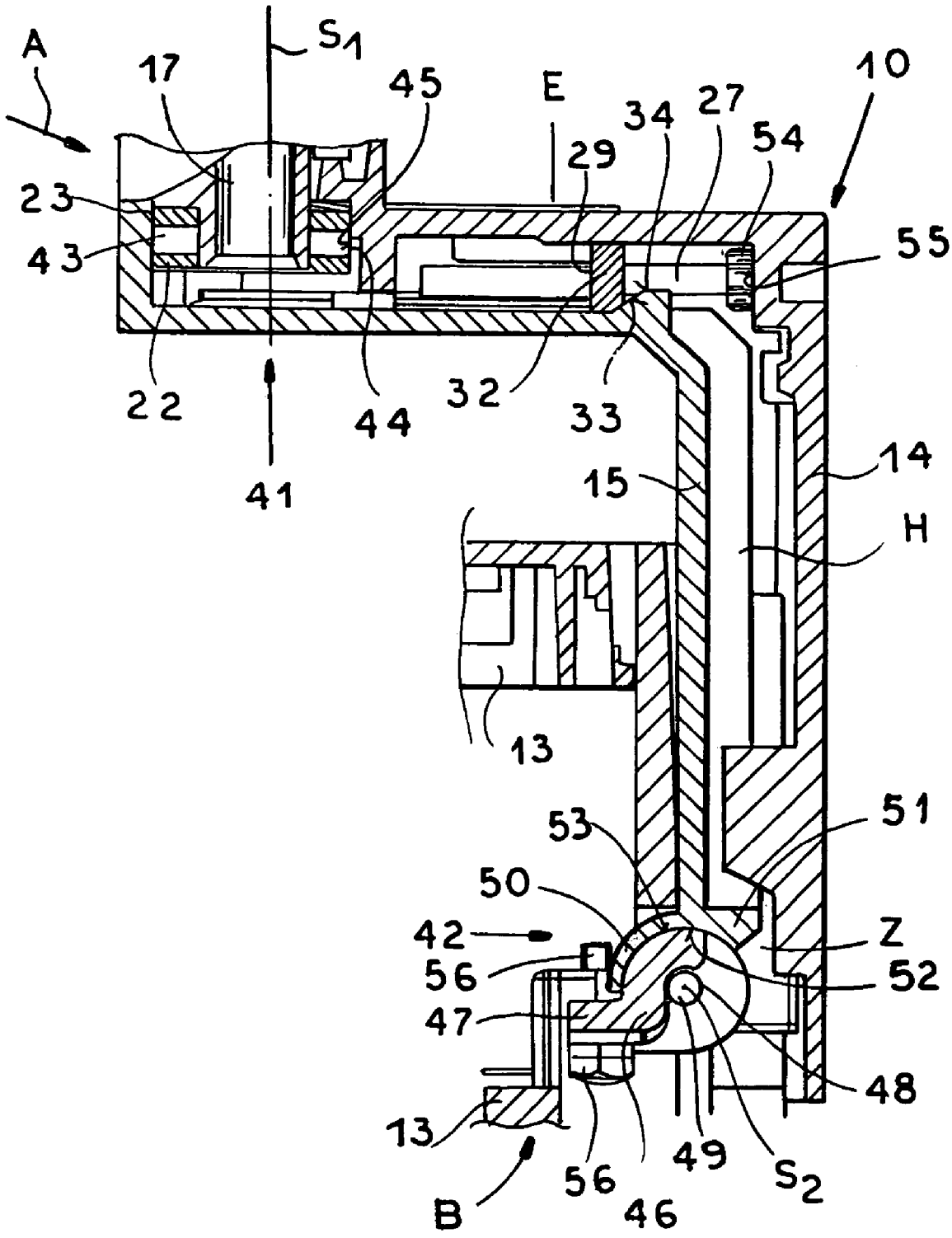
FIG. 10 is a longitudinal section through the device and through a portion of the lamp according to line X—X of FIG. 8.

As best visible in FIG. 10 the housing shell 15 is formed again as an adjustment member and has a wedge face 34 that can be engaged by a wedge face 33 of a brake part 32. The brake part 32 is here an actuating element directly on the screw 27 so that the spring of the first embodiment is not needed. In this manner particularly large forces can be exerted on the wedge faces 33 and 34.

As a result of shifting of the brake part 32 in the direction x the head 41 of the housing shell 15 is also shifted in the direction x. As most easily seen from FIGS. 9 and 10, unlike the first embodiment here there is a ring 22 connected to the bolt 17 that is connected to the power-track adapter 11 and that is arranged in the head 41 between the two jaw-like housing shells 14 and 15. The housing shell 15 engages with a concave brake face 43 that fits with the complementary brake face 23 formed by the outer surface of the ring 22. On the opposite end the ring 22 engages with its outer face 44 serving as counter surface a brake face 45 of the housing shell 14, the so-called second jaw.

Actuation of the screw 27 thus shifts the housing shell 15 relative to the housing shell 14 and grips the ring 22 between the two housing shells 14 and 15. Thus higher holding forces than the first embodiment can be exerted. A particular advantage is that the outer brake faces 23 and 44 of the ring 20 are complementary to the inner brake faces 43 and 45 of the two jaws. This makes for a particularly solid gripping.

The foot 42 of the device 10 is also different from the embodiment of FIGS. 1 to 5. The foot 42 of the housing shell 15 has a plug-like projection 51 that fits in a space Z between a below-described brake part 46 and the housing shell 14. As seen in FIG. 10 the left side of the projection 51 has a brake face 52 that is generally concave and that extends over an angle of about 60°. That angle can be for example between 20° and 80°. To the left of the brake face 52 there is a cover 50 that conceals the projection 51 and the brake part 46 in the FIG. 6 position.

The foot 42 of the housing shell 15 that extends over an angle of about 100° engages the brake part 46 that is shaped like a bearing and that has an outer surface forming a brake face 53. The brake part 46 has a bearing eye 48 in which a pivot element 49 is held. The pivot element 49 is fixed in an unillustrated manner with both its axial ends directly in the first housing shell 14.

On the left-hand lower end as seen in FIG. 10 of the brake part 46 there is a mounting tab shown only in FIG. 10 and that would in FIG. 6 extend in both directions out of the plane of view and that serves for connection of the brake part 46 for example by screws with the lamp 13.

It is notable that not the entire concave inner surface of the foot 42 of the housing shell 15 serves as a brake face, but only a portion extending over an angle of for example 40° or 60° forms the actual brake face 52. The brake face 52 and the opposite brake face 53 engage each other in surface contact and provide a considerable grip. Thus even heavy lamps can be held permanently in any set angular position.

If the brake part 32 is moved by actuation of the adjustment element 27 in the direction x, the wedge faces 33 and 34 shift the foot 42 of the housing shell 15 in the direction y. This presses the brake face 52 against the brake face 53 so that they wedge together. The brake part 46 is thus fixed relative to the pivot axis of the first housing shell 14 so that in the foot 42 the housing shell 15 is locked with respect to the housing shell 14.

It is notable that the construction of the housing shells 14 and 15 of the second embodiment is similar to that of the first embodiment. It is preferable when unillustrated stiffening ribs or webs are provided on the housing shells 14 and 15 extending inside the cavity H of the two housing shells 14 and 15.

A particular advantage of this embodiment is that the subassembly of the two housing shells 14 and 15 and the brake part 46 can be done in advance. The lamp 13 is then secured to the mounting tab 47 of the preassembled subassembly by means of two screws 56 of which only one is shown in FIG. 10. The mounting tab 27 of the brake part 46 has to this end throughgoing holes for the screws 56. This facilitates the assembly and handling of the parts to be assembled.

For clarification it is further noted that the mounting tab 47 and the fasteners 56 are not shown in FIG. 8, but only their position is shown there. The screws 57*a* and 57*b* shown in FIG. 8 serve for mounting an upper part 58 of the lamp 13 on a lower part 59 of the lamp 13.

The main difference between the rotary mount B of the second embodiment and the rotary mount B of the first embodiment is that the inner and outer bearing parts are switched. In the second embodiment the outer bearing part is the adjustable one so that higher holding forces can be exerted. To this end it is significant that one of the holding faces extends past the other.

As is clear from the above description, in the second embodiment the device is assembled as follows:

To start with, the brake part 46 for the lamp is fixed on the housing shell 14. The housing shell 14 can be fitted at an angle to the housing shell 15 so that the projection 51 fits into the cavity Z between the clamping face 53 and the housing shell 14. Then the housing shell 15 is swung clockwise relative to the housing shell 14 until the two housing shells 14 and 15 fit with each other. The wedge face 34 is brought by the pivotal movement in the direction x behind the wedge face 33. If now the screw 27 is actuated and the brake part 32 is moved in the direction x, the wedge faces 33 and 34 bear on each other. As a result the housing shell 15 is engaged at two locations with the shell 14, namely in the region of the wedge faces 33 and 34 and in the regions of the faces 52 and 53. As a result the two parts 14 and 15 are locked together. The housing shell 15 in this preassembled condition can still shift relative to the housing shell 14. To this end only the screw 27 need be actuated. This takes place only when the lamp 13 is mounted on the device 10.

Loosening of the element 27 by rotation in the opposite direction releases braking action on the lamp 13 with respect to both axes $S_1$ and $S_2$ as described above. This shifts the brake part 32 in its guide when the element 27 is actuated to move it axially as shown in FIG. 10 to the left so that the wedge faces 33 and 34 move apart. The rotary mounts A and B are thus released.

FIG. 10 shows that when the device 10 is loosened by rotation of the element 27 an abutment prevents the screw 27 from coming out of the device 10 in the direction x. If the device 10 is in fact clamped very tightly, the two wedges 33 and 34 can engage each other and lock together. If now the element 27 is reverse rotated, the brake part 32 can stick on the housing shell 15 and shift the screw 27 to the right as seen in FIG. 10, that is in the direction x out of the device 10. This is prevented by an abutment nut 54 that engages as shown in FIG. 10 with its right end on an inner face 55 of the housing shell 14.

After the screw 27 is inserted during assembly of the device 10 through the housing shell 14, the lock nut 54 can be screwed on from the left side as shown in FIG. 10 and set at a predetermined axial position on the screw 27. The nut 54 is rotationally fixed on the screw 27 and engages the inner face of the housing shell 14 to prevent the screw 27 from screwing out of the device 10.

Preferably the lock nut 54 is set at a spacing of for example about 0.5 mm from the inner face 55 so that the element 27 can be used without problems because of this play.

As an alternative to the above-described assembly of the device 10 to an easily handled unit it is also possible to first fit the housing shell 14 with the brake part 46 to the lamp 13. Then electrical lines can be fed through the cavity H of the shell 14 and connected with the lamp 13. Only then is the housing shell 15 fixed to the housing shell 14, whereupon the above-described pivoting of the housing shell 15 relative to the housing shell 14 after fitting the projection 51 into the space Z is effected.

The invention claimed is:

1. A device for mounting a lamp on a stationary support, the device comprising:

a housing defining first and second nonparallel axes;

first pivot means on the housing for securing the housing to the support for pivoting of the housing on the support about the first axis;

second pivot means on the housing for securing the lamp on the housing for pivoting thereon about the second axis;

first brake means on the housing displaceable between a rest position freeing the housing to rotate on the support about the first axis and a holding position preventing the housing from rotating on the support about the first axis;

second brake means on the housing displaceable between a rest position freeing the lamp to rotate on the housing about the second axis and a holding position preventing the lamp from rotating on the housing about the second axis; and operating means including a single actuating element on the housing and connected to both of the brake means for jointly displacing same between the rest and holding positions.

2. The lamp-mounting device defined in claim 1 wherein the first brake means includes a brake face on the support directed radially of the first axis; and a first brake face on the housing directed radially of the first axis toward the support brake face and displaceable radially toward and away from the support brake face, whereby, when the first housing brake face bears radially on the support brake face, rotation of the housing on the support about the first axis is inhibited, the second brake means including a brake face on the lamp directed radially of the second axis; and a second brake face on the housing directed radially of the second axis and displaceable radially toward and away from the lamp brake face, whereby, when the second housing brake face bears radially on the lamp brake face, rotation of the lamp on the housing about the second axis is inhibited.

3. The lamp-mounting device defined in claim 2 wherein the operating means includes an adjustment member connected to the actuating element and forming the first and second housing brake faces.

4. The lamp-mounting device defined in claim 3 wherein the adjustment member is a single unitary part unitarily formed with both of the housing brake faces.

5. The lamp-mounting device defined in claim 4 wherein the axes are generally perpendicular and the first and second brake faces are directed generally perpendicular to each other.

6. The lamp-mounting device defined in claim 3 wherein the operating means includes a wedge displaceable in a predetermined straight-line direction on the housing and having a wedge face extending at an acute angle to both of the axes, the adjustment member having a wedge face extending at an acute angle to both of the axes and generally flatly engaging the wedge face of the wedge; and means operatively connecting the wedge with the actuating element for shifting the wedge in the predetermined direction and thereby pressing the wedge faces together and displacing the adjustment member generally perpendicular to both the first and second axes.

7. The lamp-mounting device defined in claim 6 wherein the operating means further includes a slide shiftable in the predetermined direction in the housing and directly connected to the actuating element;

a spring braced in the predetermined direction between the slide and the wedge.

8. The lamp-mounting device defined in claim 6 wherein the predetermined direction is radial of one of the axes.

9. The lamp-mounting device defined in claim 6 wherein the predetermined direction is radial of the first axis.

10. The lamp-mounting device defined in claim 6 wherein the actuating element is a screw extending in the predetermined direction.

11. The lamp-mounting device defined in claim 10 wherein the screw is braced in the direction against the housing.

12. The lamp-mounting device defined in claim 3 wherein the first pivot means includes a pin fixed on the support and extending along and centered on the first axis; and structure on the housing forming a hole snugly surrounding the pin.

13. The lamp-mounting device defined in claim 12 wherein the first brake means includes a ring fixed on the pin and having an annular outer surface centered on the first axis and forming the support brake face.

14. The lamp-mounting device defined in claim 3 wherein the second pivot means includes a pin and a bore formed on the lamp and housing with the pin and bore fitted complementarily together and centered on the second axis, the lamp brake face being directed radially inward toward the second axis.

15. The lamp-mounting device defined in claim 14 wherein the pin is provided on the lamp and the bore on the housing.

16. The lamp-mounting device defined in claim 3 wherein the housing includes a first housing shell defining the first and second axes, the adjustment member being a second housing shell fittable with the first housing shell, movable radially of both axes on the first housing shell, and forming with the first housing shell a cavity containing the brake means and operating means.

17. The lamp-mounting device defined in claim 16 wherein the shells are both L-shaped.

18. The lamp-mounting device defined in claim 16 wherein the shells are concave toward each other.

19. The lamp-mounting device defined in claim 1 wherein the support is a power-track adapter.

20. The lamp-mounting device defined in claim 1 wherein the axes are generally perpendicular to each other.

* * * * *